US011466842B2

(12) United States Patent
Baxter et al.

(10) Patent No.: US 11,466,842 B2
(45) Date of Patent: Oct. 11, 2022

(54) ADJUSTABLE LIGHT SHAPING VISOR

(71) Applicant: SPORTSBEAMS LIGHTING, INC., Round Rock, TX (US)

(72) Inventors: Kevin C. Baxter, Tulsa, OK (US); Wei Cao, Shanghai (CN); Jianjun Gu, Shanghai (CN)

(73) Assignee: Sportsbeams Lighting, Inc., Round Rock, TX (US)

( * ) Notice: Subject to any disclaimer, the term of this patent is extended or adjusted under 35 U.S.C. 154(b) by 0 days.

(21) Appl. No.: 17/265,148

(22) PCT Filed: Jul. 31, 2019

(86) PCT No.: PCT/US2019/044530

§ 371 (c)(1),
(2) Date: Feb. 1, 2021

(87) PCT Pub. No.: WO2020/028582

PCT Pub. Date: Feb. 6, 2020

(65) Prior Publication Data

US 2021/0325025 A1 Oct. 21, 2021

(51) Int. Cl.
*F21V 17/00* (2006.01)
*F21V 7/24* (2018.01)
(Continued)

(52) U.S. Cl.
CPC ..... *F21V 17/002* (2013.01); *F21V 7/04* (2013.01); *F21V 7/24* (2018.02); *F21V 9/40* (2018.02); *F21Y 2115/10* (2016.08)

(58) Field of Classification Search
CPC ..... F21V 17/002
See application file for complete search history.

(56) References Cited

U.S. PATENT DOCUMENTS 5,584,574 A 12/1996 Haddad
5,707,142 A 1/1998 Gordin
(Continued)

FOREIGN PATENT DOCUMENTS

EP 2492580 A2 8/2012
JP 5413457 A 1/1979

OTHER PUBLICATIONS

International Search Report and Written Opinion dated Dec. 4, 2019 issued in PCT/US2019/044530 prepared by the ISA/US.

*Primary Examiner* — Bryon T Gyllstrom
*Assistant Examiner* — Christopher E Dunay
(74) *Attorney, Agent, or Firm* — GableGotwals

(57) ABSTRACT

A light shaping apparatus consisting of two or more components which may be die cast from aluminum, magnesium, or similar materials that are meant to be attached to existing LED venue lighting fixtures. These components are designed so that they can be rotated and adjusted on the fixture circumference/edge. A semi-circular snoot flares out slightly from the outer edge of the fixture to reflect light that would normally be absorbed by a visor. The snoot may include a reflector on its inside surface. The snoot has connection points that mate with the fixture. The snoot also has connection points which allow it to be connected to a semi-circular bowl spaded brow adapted for cutting into the beam of light and block some of light emitted from the fixture. The brow is preferably one piece and has multiple sets of thin shear lines cast into it such that the length of the brow can be modified by breaking off material along the shear lines.

20 Claims, 7 Drawing Sheets

(51) Int. Cl.

| | |
|---|---|
| ***F21V 9/40*** | (2018.01) |
| ***F21V 7/04*** | (2006.01) |
| *F21Y 115/10* | (2016.01) |

(56) References Cited

U.S. PATENT DOCUMENTS

| | | | | |
|---|---|---|---|---|
| 6,149,283 | A | 11/2000 | Conway et al. | |
| 6,497,501 | B1 * | 12/2002 | Harder | F21V 17/04 362/359 |
| 7,347,592 | B2 | 3/2008 | Mardilovich et al. | |
| 7,789,540 | B2 | 9/2010 | Gordin et al. | |
| 2005/0128752 | A1 * | 6/2005 | Ewington | F21S 4/28 362/294 |
| 2006/0181875 | A1 * | 8/2006 | Gordin | F21S 8/086 362/282 |
| 2006/0198145 | A1 | 9/2006 | Gordin | |
| 2014/0247602 | A1 * | 9/2014 | Kinzer | F21V 13/04 362/308 |
| 2015/0308655 | A1 * | 10/2015 | Holmes | F21V 29/83 362/294 |
| 2017/0184261 | A1 * | 6/2017 | Casper | F21V 29/74 |
| 2018/0356071 | A1 * | 12/2018 | Jordan | F21V 11/00 |
| 2021/0041095 | A1 * | 2/2021 | Dost | F21V 15/013 |

* cited by examiner

ADJUSTABLE LIGHT SHAPING VISOR

CROSS REFERENCE TO RELATED APPLICATION

This application claims the benefit of U.S. Provisional Application No. 62/712,858 filed Jul. 31, 2018, herein incorporated by reference in its entirety for all purposes.

FIELD OF THE INVENTION

Large area lighting involves outdoor lighting used in sports venues, parks, airports, ports and other areas that have similar large geometry problems. Though HID bulbs have traditionally powered these fixtures LED fixtures are now beginning to take over due to their lower maintenance costs.

BACKGROUND OF THE INVENTION

These LED fixtures generally have a compact but powerful LED array which is surrounded with a parabolic shaped reflector. Visors are then usually added to the outside of the fixture in order to change the shape of the light or to keep it from spilling off to the sides or top or bottom. These visors are usually constructed of aluminum and made specific to the light shaping job that they are intended for, which means there are many different kinds. Because there are so many different types of visors needed this harms the equation of economies-of-scale. There are too many different types of visors needed and not enough of one kind to allow for die casting, and die casting tools are very expensive. Needing multiple die casting tools is simply prohibitively expensive.

Also these visors can add wind resistance to the fixture. There are wind resistance coefficients that are called Effective Projected Area ("EPA") where the lower the number, the less drag, the higher the number means the fixture is catching a lot of wind and that force is pushing the fixture substantially as well as the structure or pole that it is mounted on. The visors shape and size has a great deal to do with the EPA. Visors generally have a logo sticker added to them, but because these fixtures are out in the elements for up to 30 years they tend to fade or even tear off in the wind and sun and rain.

SUMMARY OF THE INVENTION

The present invention provides a light shaping solution which consists of 2 or more pieces which are die cast from aluminum, magnesium, or similar materials that are meant to be attached to existing LED fixtures. These parts are designed so that they can be rotated and adjusted in many ways. This means that as few as only 2 die cast molds are required in order to have visors that can be adjusted and manipulated to make visors with the possibility of hundreds of variations.

The first part is called the snoot; it is a semi-circular ring that flares out slightly from the fixture. It can efficiently reflect light that would normally be absorbed by a visor. The reflector inside the snoot is optional and can be omitted in an alternate embodiment if the lighting design requires for the light to be absorbed. The inner surface of the snoot can be painted black if necessary. This snoot has connection points that mate with the fixture. The snoot also has connection points on the outer edges which allow it to be connected to the "brow".

The brow is a semi-circular bowl spaded part. It cuts into the beam of light and blocks some of light that is being emitted by the fixture. The inventive device is made as one piece but it has multiple sets of thin shear lines cast into it so that the length of the brow can be modified by breaking the molded part along the shear lines. Leaving the brow whole will cause the most amount of light to be cut from the beam. Breaking the brow along the first shear line will make it just a little shorter and cut a little less than a whole part. Breaking the brow at the last shear line will be its shortest configuration and allow the most amount of light to leave the fixture assembly. There can be a few as one shear line or as many as needed in the inventive device. The brow can include a non-reflective surface on the inside if needed.

In a particular embodiment the brow could be left off all together and the fixture could be used only with the snoot. Further, two snoots could be used together because each only goes about 180 degrees around the fixture, two would go 360 degrees around. The number of mounting points can vary but the preferred embodiment has them spaced evenly so that the snoot and or brow can be rotated around the fixture. Brows are traditionally at the top of the fixture but they can be mounted on the side or bottom or somewhere in-between if needed by the lighting designer.

The unique shape of the brow in the present disclosure also lowers the EPA. A straight visor would catch air and increase the EPA whereas the brow of the present disclosure is preferably bowl shaped and its round dimension provides very little air resistance.

Thus, the present disclosure, in a preferred embodiment, sets forth a light shaping visor for removable attachment to an LED venue lighting fixture having an outer circumference which is at least partially round. The visor includes a snoot adapted for removable attachment to the outer circumference of the visor. The snoot extends at least partially around the outer circumference of the visor. The snoot being radially repositionable around the outer circumference of the visor.

The brow of the present disclosure is preferably die-cast and includes a 3 dimensional relief of a logo so that the logo does not fade or peel off over time. The raised logo could be painted differently from the lower level brow in order to bring further attention to the logo or it could alternatively use adhesive labels for color.

The foregoing has outlined in broad terms the more important features of the invention disclosed herein so that the detailed description that follows may be more clearly understood, and so that the contribution of the instant inventors to the art may be better appreciated. The instant invention is not limited in its application to the details of the construction and to the arrangements of the components set forth in the following description or illustrated in the drawings. Rather the invention is capable of other embodiments and of being practiced and carried out in various other ways not specifically enumerated herein. Additionally, the disclosure that follows is intended to apply to all alternatives, modifications and equivalents as may be included within the spirit and the scope of the invention as defined by the appended claims. Further, it should be understood that the phraseology and terminology employed herein are for the purpose of description and should not be regarded as limiting, unless the specification specifically so limits the invention.

DETAILED DESCRIPTION OF THE PREFERRED EMBODIMENTS

The embodiments herein and the various features and advantageous details thereof are explained more fully with reference to the non-limiting embodiments that are illustrated in the accompanying drawings and detailed in the following description. Descriptions of well-known components and processes and manufacturing techniques are omitted so as to not unnecessarily obscure the embodiments herein. The examples used herein are intended merely to facilitate an understanding of ways in which the invention herein may be practiced and to further enable those of skill in the art to practice the embodiments herein. Accordingly, the examples should not be construed as limiting the scope of the claimed invention. It is to be understood that the phraseology and terminology employed herein is for the purpose of description and not of limitation.

Figure 1:
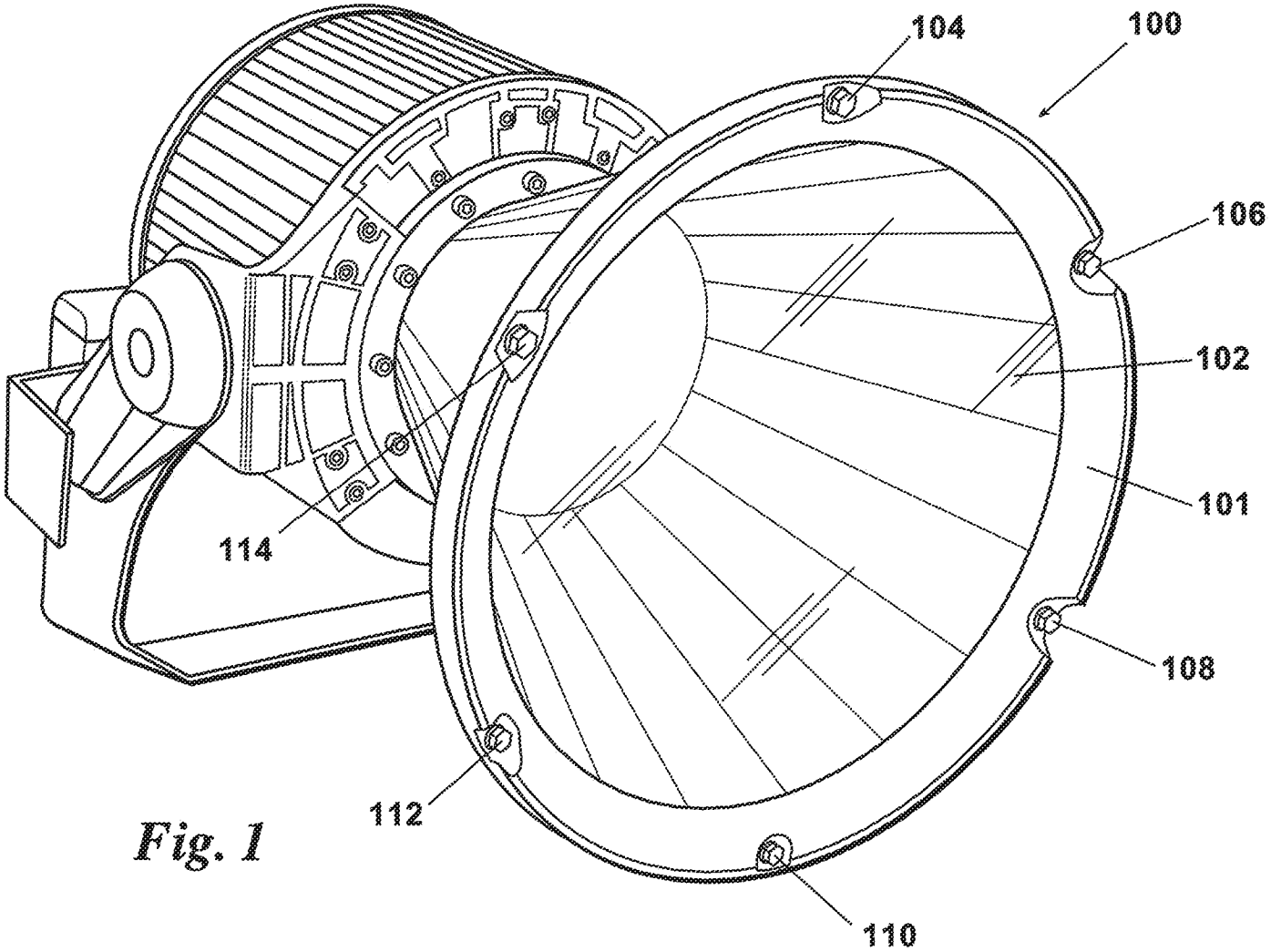
FIG. 1 depicts a large area LED lighting fixture (prior art).

Referring now to the drawings, wherein like reference numerals indicate the same parts throughout the several views, a representative LED lighting fixture 100 is shown in FIG. 1. This LED lighting fixture is manufactured by Sports-Beams Lighting, Inc., based in Roundrock Texas. Around the front circumference or edge 101 of fixture 100's circular lens 102 are mounting points 104-114 that in the preferred embodiment are simply tapped holes. These holes are evenly spaced and can vary in number. Although the geometry of circumference 101 is depicted as annular, it should be understood that other geometries are contemplated.

Figure 2:
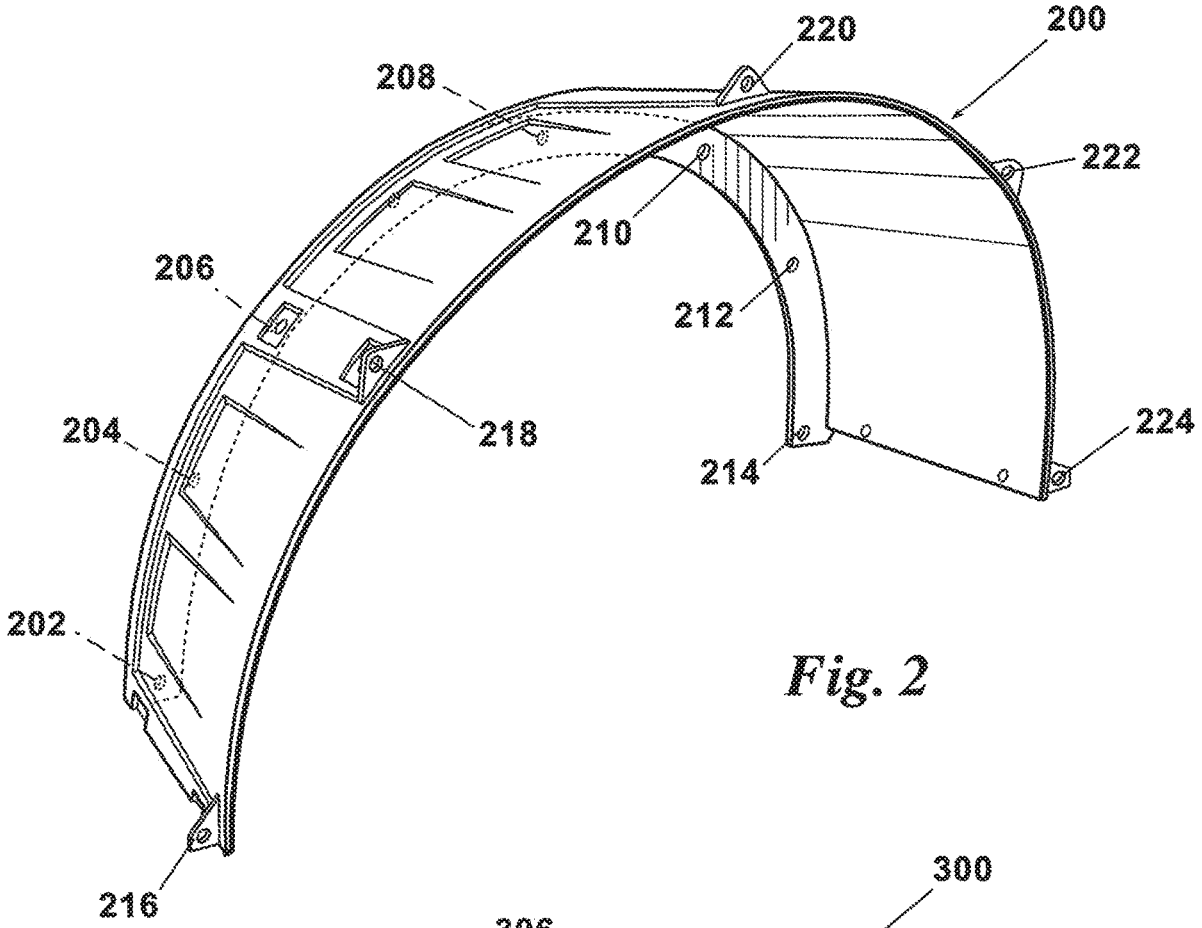
FIG. 2 depicts the snoot of the present disclosure.

Referring now to the next drawing, the snoot 200 in FIG. 2. In a preferred embodiment, the snoot has points 202-214 that mount to the light fixture 100 (of FIG. 1) around circumference 101. In a preferred embodiment these points are simply holes that bolts are inserted through and match the tapped holes 104-114 in the edge 101 LED lighting fixture 100. The snoot 200 is die cast of a light weight material such as aluminum or injection molded of plastic. On the side of the snoot 200 furthest from the light are mounting receiver points 216-224 that in the preferred embodiment would be tapped holes. There can be many more mounting points 216-224 on the snoot 200 than are on the fixture 100 as long as there is a matching geometry. This would allow for minute, either continuous or incremental rotational positioning of the snoot 200 to the fixture 100.

Figure 3:
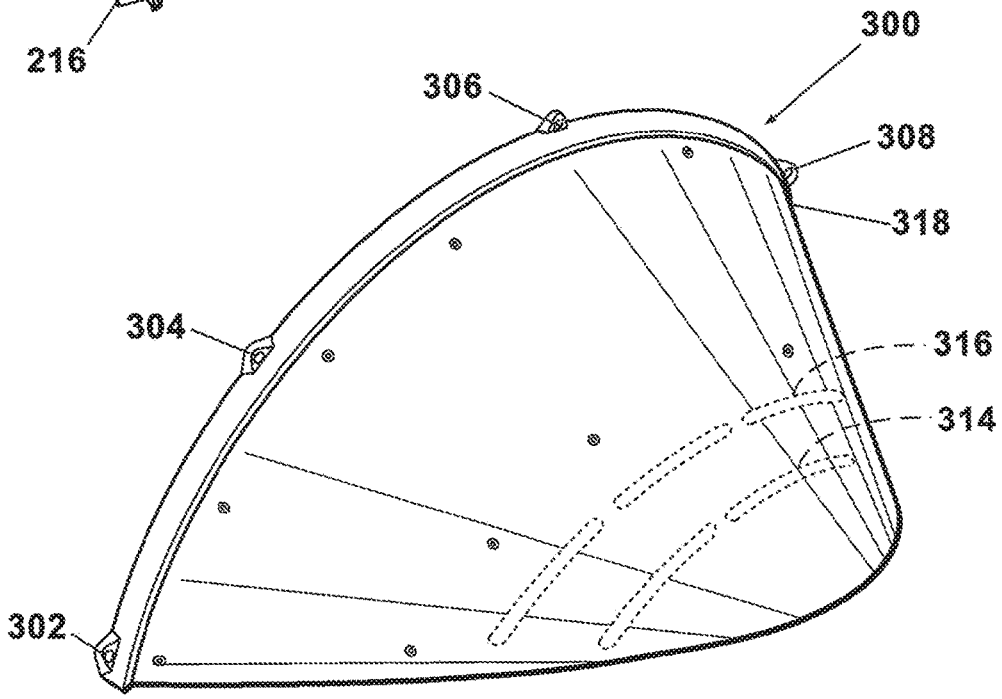
FIG. 3 depicts an entire brow (unmodified) of the present disclosure.

Referring now to the next drawing, the brow 300 in FIG. 3. In a preferred embodiment, the brow has mounting points 302-310 (310 not being visible in FIG. 3) that mount to the snoot 200 and its mounting points 216-224 (from FIG. 2). The brow 300 has a bowl-like shape, that when mounted to the fixture 100 (of FIG. 1) either though a snoot 200 (FIG. 2) or directly, blocks some of the light projected from fixture 100. In a preferred embodiment the thickness of brow 300 would be between 1.5 and 3 mm depending on the material used. Snoot 200 and brow 300 together form a visor assembly 205.

The brow 300 could have one or more shear lines 314 and 316 that are areas that run radially around the open end of the brow 300. It should be understood that brow 300 could have other shear lines in addition to 314 and 316, or only one shear line, as desired. These shear lines 314 and 316 are where the die casting would leave the cast material very thin, possibly less than 1 mm thick, and easy to break or shear. The multiple shear lines 314 and 316 would be from near the open edge to near the fixture edge of the brow 300. The removal of brow material along the shear lines 314 and 316 could be accomplished by shear, or saw, or any one of many different methods. Note the raised logo 318 that has been die cast into the brow 300. This allows branding 318 without the additional expense of labels or pad printing.

Figure 4:
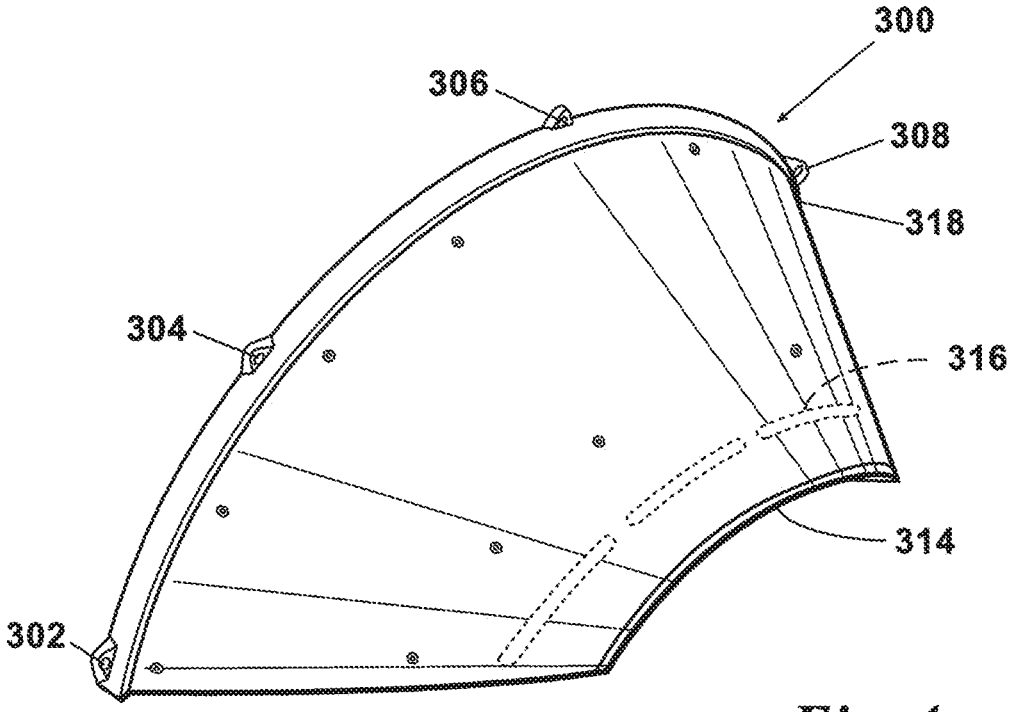
FIG. 4 depicts a brow of the present disclosure with 1 portion removed (modified).

Referring now to the next drawing, the brow 300 in FIG. 4. In this view a portion of the brow 300 has been broken off along the shear line 314 and the brow's encroachment into the light's path has thus been reduced.

Figure 5:
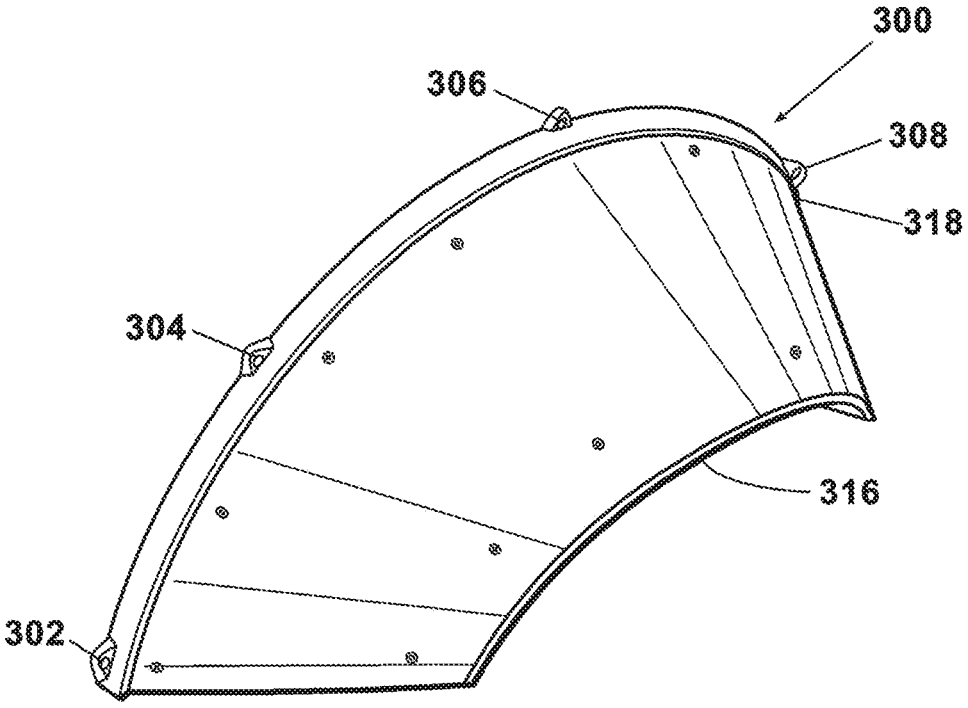
FIG. 5 depicts a brow of the present disclosure with all removable portions removed (modified).

Referring now to the next drawing, the brow 300 in FIG. 5. In this view a portion of the brow 300 has been broken off along the shear line 316 and the brow's encroachment into the light's path has been further reduced from that of the embodiment of FIG. 4.

Figure 6:
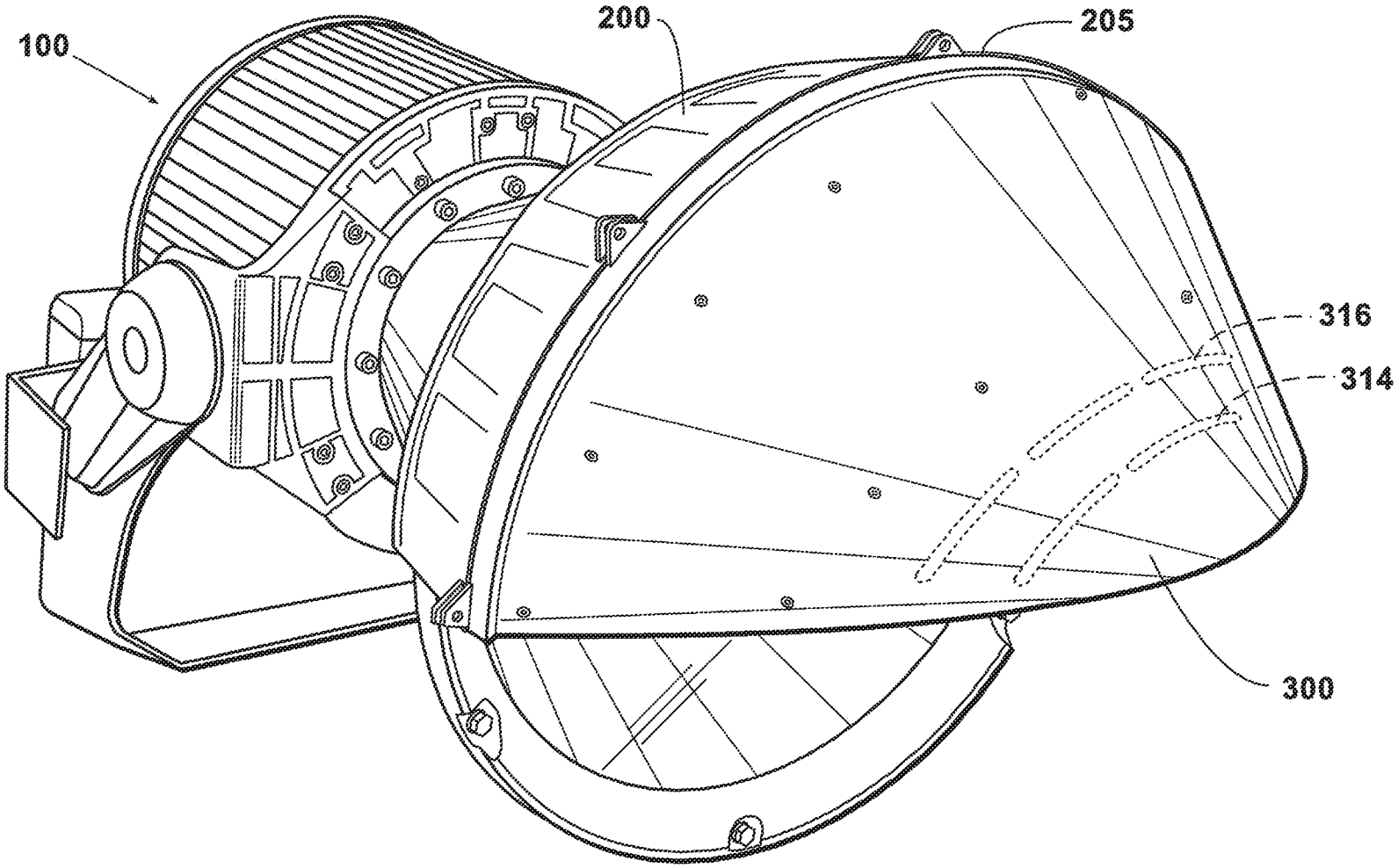
FIG. 6 depicts a fixture, snoot, and brow of the present disclosure assembled together as a fixture with a visor.

Referring now to FIG. 6, the fixture 100, snoot 200, and brow 300 are shown as one assembly. In this view one can easily see how the visor assembly 205 of the present disclosure would look when attached to a lighting fixture 100.

Figure 7:
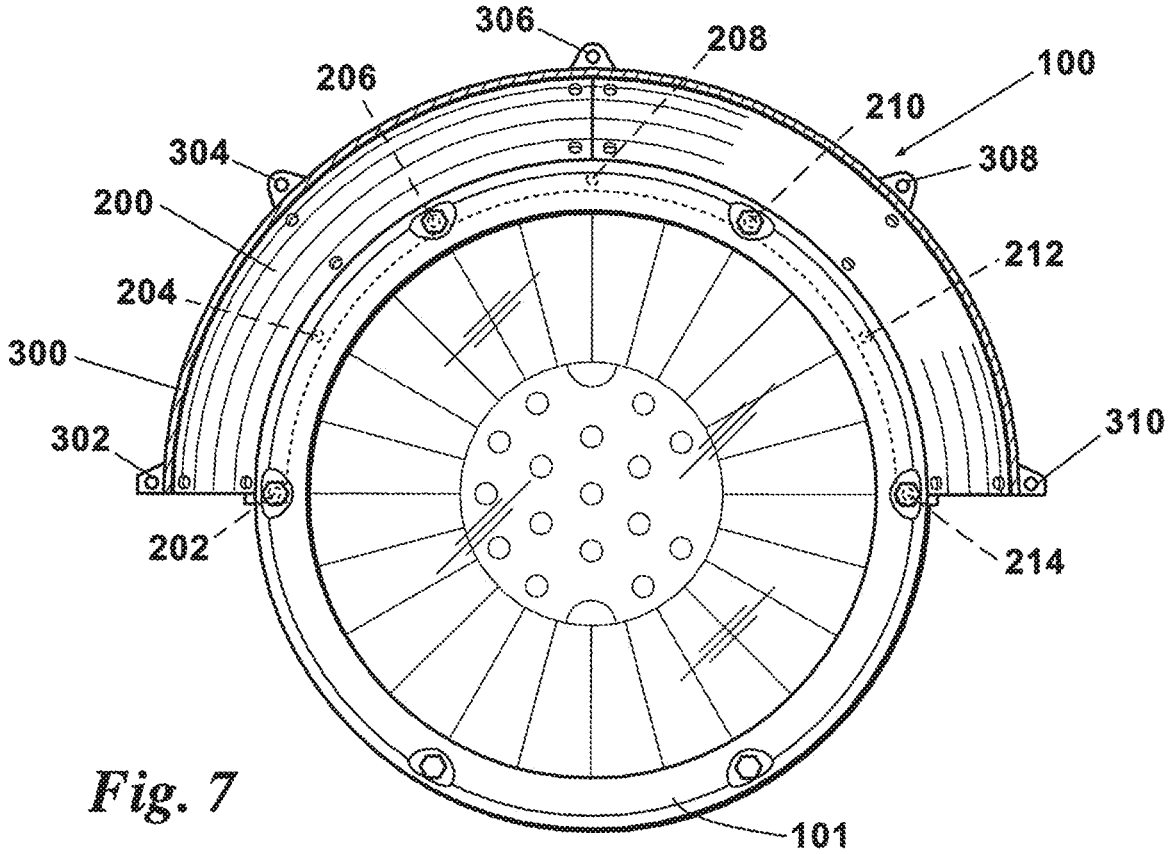
FIG. 7 shows the front view of a fixture with the snoot and brow of the present disclosure oriented at the top.

Referring now to the next drawing, the fixture 100, snoot 200, and brow 300 in FIG. 7 are shown as the same assembly as in FIG. 6 but from the front in a partial cut-away view in order to show the subtleties of the rotational orientation. In the embodiment of FIG. 6, visor assembly 205 is oriented at the very top of fixture 100.

Figure 8:
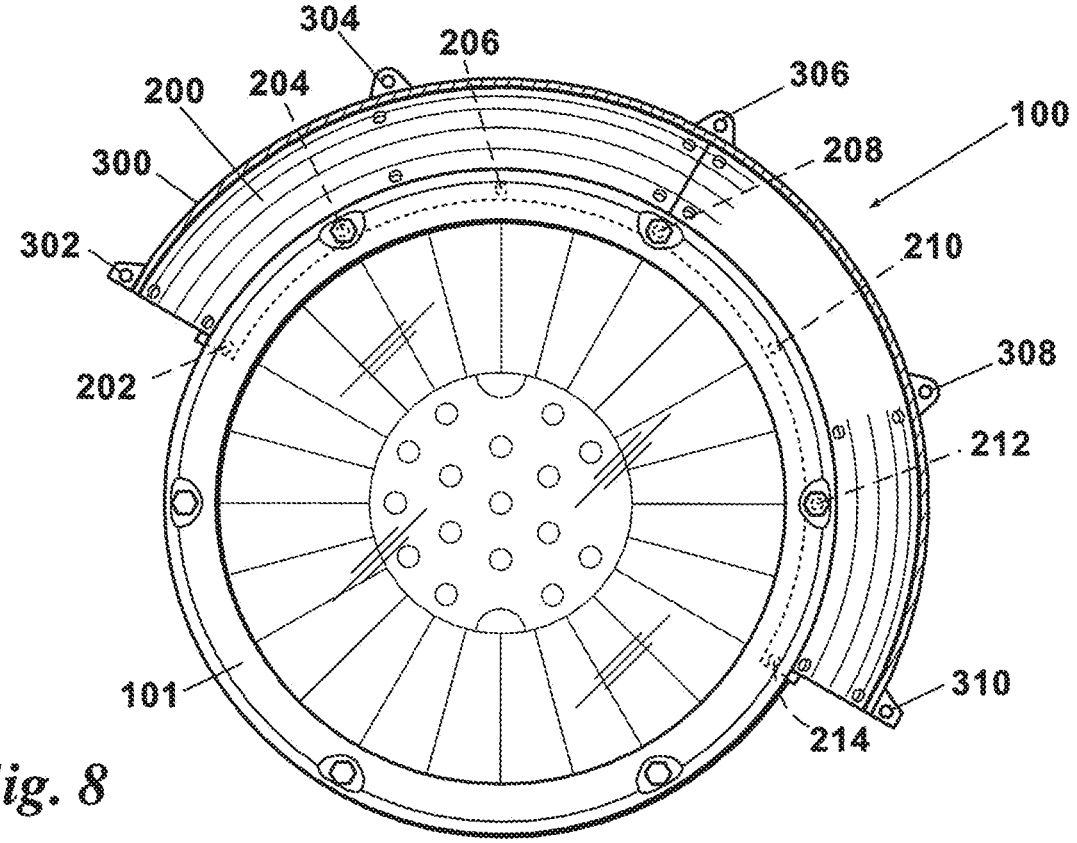
FIG. 8 shows the front view of a fixture with the snoot and brow of the present disclosure rotated clockwise one place.

Referring now to the next drawing, the fixture 100, snoot 200, and brow 300 in FIG. 8 are shown from the same perspective and as the same assembly as in FIG. 7 but the visor assembly 205 is oriented one mounting point position clockwise on edge 101 from that depicted in FIG. 7.

Figure 9:
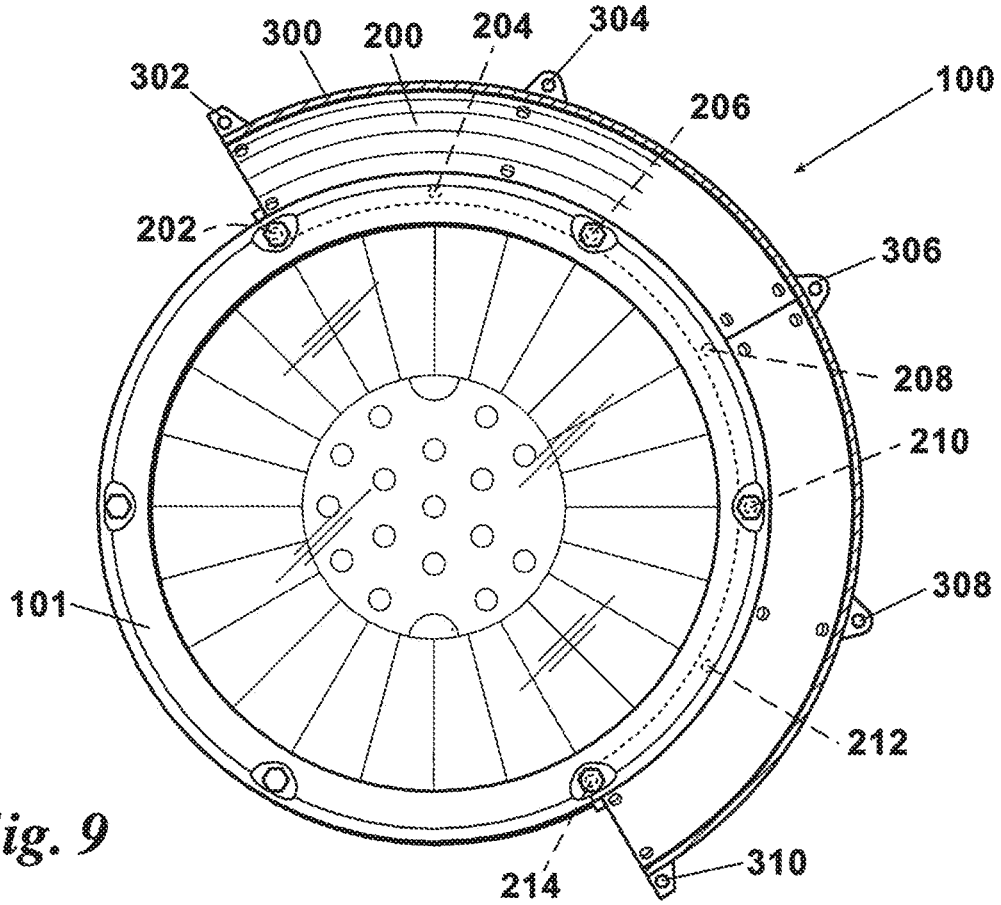
FIG. 9 shows the front view of a fixture with the snoot and brow of the present disclosure rotated clockwise two places.

Referring now to the next drawing, the fixture 100, snoot 200, and brow 300 in FIG. 9 are shown from the same perspective and as the same assembly as in FIG. 7 and FIG. 8 but the visor assembly 205 is oriented one further mounting point position clockwise on edge 101 of fixture 100 from what is depicted in FIG. 8. This rotation could be continued to match any mounting point for a large number of contemplated orientation possibilities.

Figure 10:
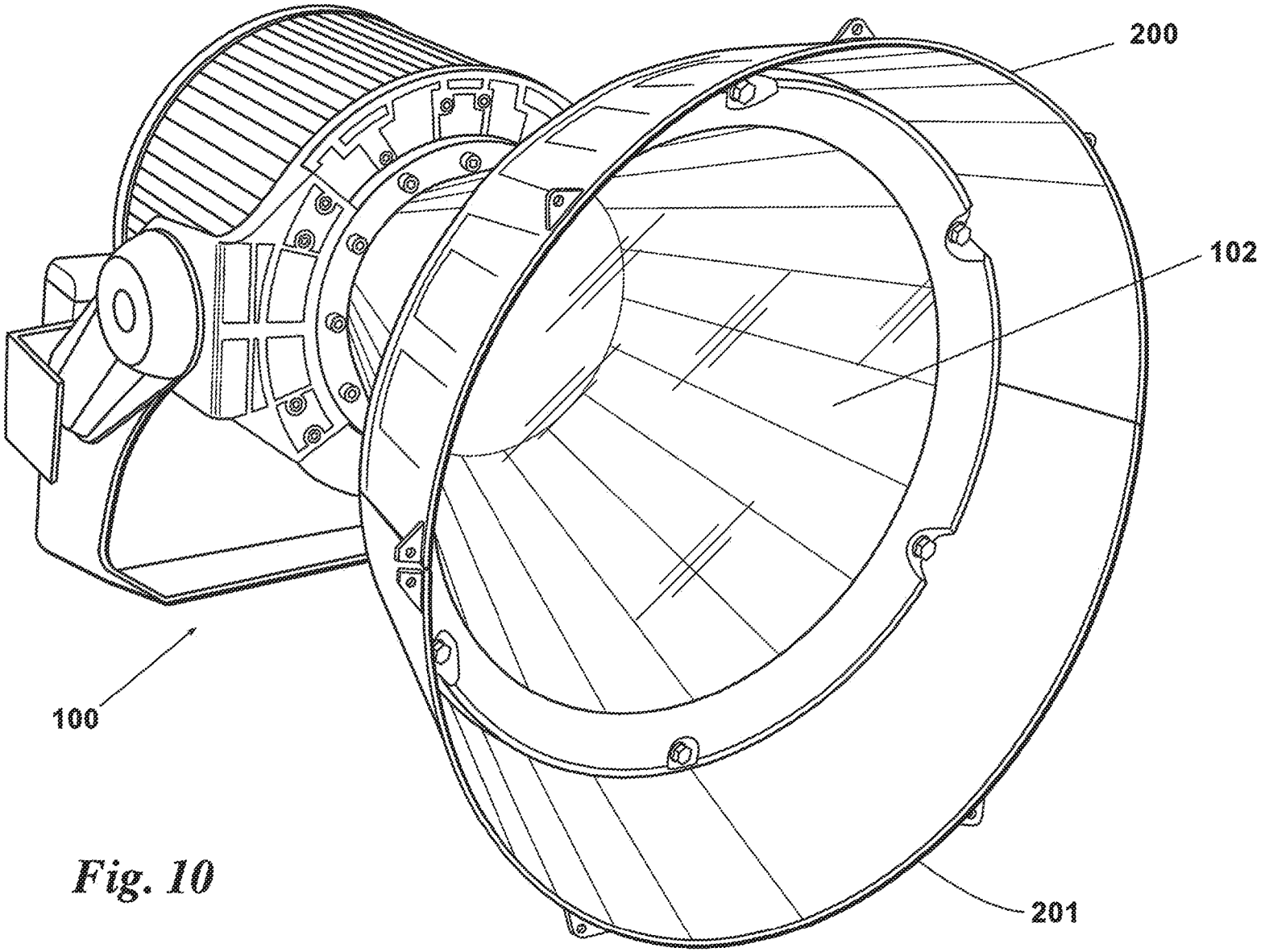
FIG. 10 depicts a fixture with a double snoot of the present disclosure.

Referring now to the next drawing, two snoots 200 and 201 are mounted to the fixture 100 in FIG. 10. In a preferred embodiment, the two snoots 200 and 201 would match seamlessly and block all light around the perimeter with no leaks.

Figure 11:
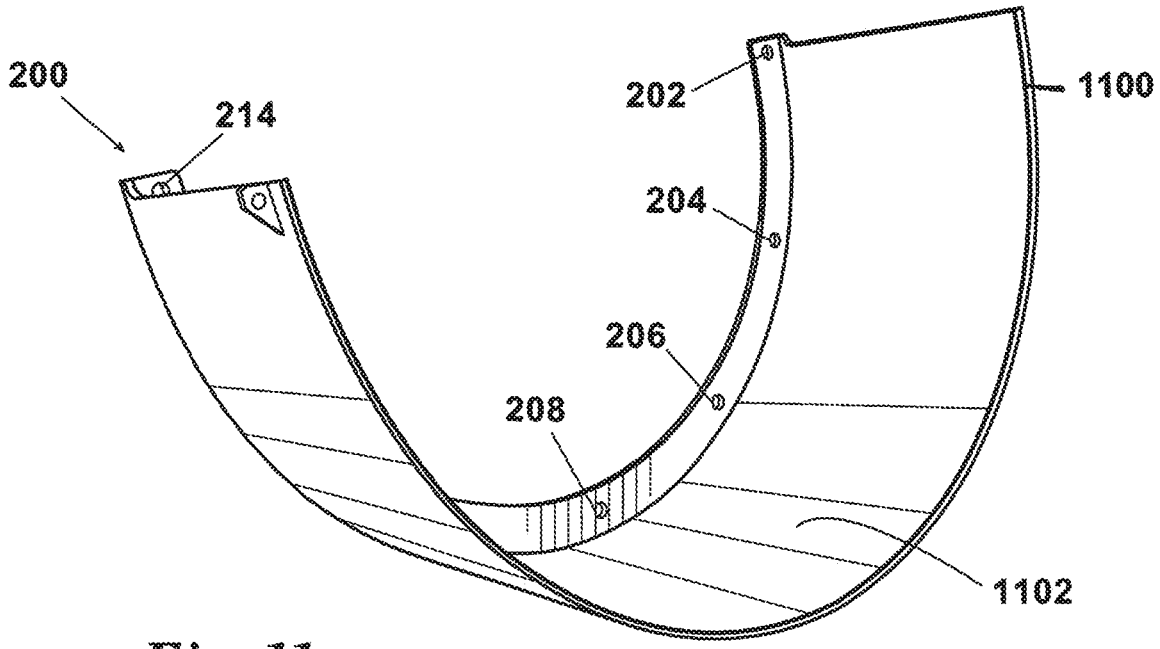
FIG. 11 depicts the underside of a snoot of the present disclosure with a reflector.

Referring now to the final drawing, the snoot 200 is shown in FIG. 11 such that its inside surface 1100 includes a reflector 1102 permanently mounted to the surface 1100. Ideally both adhesive and rivets (or screws) would attach the reflector 1102 to the inside surface 1100 of snoot 200. This reflector 1102 in a preferred embodiment should be no more than 94% efficient and is optional. In an alternate embodiment reflector could be less than 92%, 90% or other suitable reflectivity. Embodiments of the snoot 200 can be made with the reflector 1102 or without the reflector for maximum flexibility for the lighting designer.

In one embodiment, snoot 200 includes an inside surface 1100 coated with a light modifying material. Alternatively, snoot 200 may include an inside surface 1100 coated with a light absorbing material. In an alternate embodiment, reflector 1102 may include an inside surface coated with a light modifying material. This light modifying material may be highly reflective, moderately reflective, or light absorbing. Inside surface 1102 may be highly polished aluminum for maximum reflectivity or may be a material painted with light absorbing (black) paint or may be painted any suitable color, such as silver, white, gray, or black, without limitation.

Reflector 1102 may include an inside surface having a smooth texture. Alternatively, reflector 1102 may include an inside surface having a pebbled texture. Such a pebbled texture may be suitable for breaking up spectral rays of light emitted from the LED module/fixture.

Also, in another embodiment, brow 300 may include an inside surface 316 such that a reflector is attached to inside surface 316. The reflector may be configured to cover all or only a portion of the inside surface 316 of brow 300. Inside surface 316 of reflector 300 may be coated with a light modifying material. The brow reflector may be polished, painted, or coated in the same manner as described above in relation to the snoot reflector.

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the scope and spirit of this invention.

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. Terms of approximation (e.g., "about", "substantially", "approximately", etc.) should be interpreted according to their ordinary and customary meanings as used in the associated art unless indicated otherwise. Absent a specific definition and absent ordinary and customary usage in the associated art, such terms should be interpreted to be ±10% of the base value.

When, in this document, a range is given as "(a first number) to (a second number)" or "(a first number)–(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Thus, the present invention is well adapted to carry out the objects and attain the ends and advantages mentioned above as well as those inherent therein. While presently preferred embodiments have been described for purposes of this disclosure, numerous changes and modifications will be apparent to those skilled in the art. Such changes and modifications are encompassed within the spirit of this invention as defined by the appended claims.

What is claimed is:

1. A light shaping visor for removable attachment to an LED venue lighting fixture having an outer circumference which is at least partially round and a plurality of mounting points spaced about said outer circumference, the visor comprising:

a snoot adapted for removable attachment to the outer circumference, said snoot comprising a plurality of attachment points configured to mate with at least some of said mounting points;

said snoot extending at least partially around the outer circumference;

said mounting points and said attachment points being spaced such that said snoot is radially repositionable around the outer circumference at discrete angles where at least some of said mounting points and some of said attachment points align.

2. The visor of claim 1 further including a brow affixed to said snoot.

3. The visor of claim 2 wherein the snoot extends entirely around the outer circumference.

4. The visor of claim 3 wherein the snoot is adapted for attachment around the outer circumference at multiple positions.

5. The visor of claim 3 wherein the snoot is adapted for attachment approximately half-way around the outer circumference.

6. The visor of claim 5 including a second snoot adapted for attachment approximately around the remainder of the outer circumference.

7. The visor of claim 2 wherein the brow includes:

a first thickness of said brow;

a second thickness of said brow, smaller then said first thickness, to form an indention along at least one shear line, said indention extending continuously from a first side of said brow to a second side of said brow opposite said first side.

8. The visor of claim 7 wherein a portion of the brow is configured to be removed along said at least one shear line.

9. The visor of claim 7 wherein the brow includes multiple shear lines, the brow having said second thickness along each of said multiple shear lines.

10. The visor of claim 2 wherein said brow includes an inside surface and a reflector is attached to said inside surface.

11. The visor of claim 10 wherein said reflector includes an inside surface coated with a light modifying material.

12. The visor of claim 1 wherein the snoot includes an inside surface coated with a reflective material.

13. The visor of claim 1 wherein said snoot includes an inside surface coated with a light modifying material.

14. The visor of claim 1 wherein said snoot includes an inside surface coated with a light absorbing material.

15. The visor of claim 1 wherein said snoot includes an inside surface and a reflector is attached to said inside surface.

16. The visor of claim 15 wherein said reflector includes an inside surface coated with a light modifying material.

17. The visor of claim 16 wherein said light modifying material is highly reflective.

18. The visor of claim 16 wherein said light modifying material absorbs light.

19. The visor of claim 16 wherein said reflector includes an inside surface having a smooth texture.

20. The visor of claim 16 wherein said reflector includes an inside surface having a pebbled texture.

* * * * *